US007757598B2

(12) United States Patent
Simon et al.

(10) Patent No.: US 7,757,598 B2
(45) Date of Patent: Jul. 20, 2010

(54) HYDROSTATIC BEARING ARRANGEMENT FOR PUMP SWASHPLATE HAVING SECONDARY ANGLE

(75) Inventors: Matthew H. Simon, Kalamazoo, MI (US); Bernard J. Strehlow, Otsego, MI (US)

(73) Assignee: Parker-Hannifin Corporation, Cleveland, OH (US)

( * ) Notice: Subject to any disclaimer, the term of this patent is extended or adjusted under 35 U.S.C. 154(b) by 0 days.

(21) Appl. No.: 12/260,815

(22) Filed: Oct. 29, 2008

(65) Prior Publication Data

US 2009/0110564 A1 Apr. 30, 2009

Related U.S. Application Data

(60) Provisional application No. 60/983,340, filed on Oct. 29, 2007.

(51) Int. Cl.
*F01B 3/02* (2006.01)
*F04B 1/22* (2006.01)

(52) U.S. Cl. ..... 92/12.2; 92/DIG. 2; 417/269

(58) Field of Classification Search ..... 91/505; 92/13; 417/269
See application file for complete search history.

(56) References Cited

U.S. PATENT DOCUMENTS

| | | | | |
|---|---|---|---|---|
| 1,019,521 | A | 3/1912 | Pratt | |
| 2,967,491 | A | 1/1961 | Wiggerman | |
| 3,108,543 | A | 10/1963 | Gregor | |
| 3,123,014 | A | 3/1964 | Gregor | |
| 3,175,510 | A | 3/1965 | D'Amato | |
| 3,376,822 | A * | 4/1968 | Leduc et al. | 92/12.2 |
| RE26,519 | E | 1/1969 | D'Amato | |
| 3,943,828 | A | 3/1976 | Wagenseil | |
| 4,026,195 | A | 5/1977 | Forster | |
| 4,029,367 | A | 6/1977 | Schwede et al. | |
| 4,167,895 | A | 9/1979 | Rubinstein | |
| 4,492,527 | A * | 1/1985 | Swain et al. | 417/222.2 |
| 4,543,876 | A | 10/1985 | Heyl et al. | |
| 4,584,926 | A | 4/1986 | Beck, Jr. et al. | |
| 4,627,330 | A | 12/1986 | Beck, Jr. | |
| 4,896,583 | A | 1/1990 | Lemke | |
| 5,094,144 | A | 3/1992 | Akasaka et al. | |
| 5,182,978 | A | 2/1993 | Akasaka et al. | |
| 5,205,123 | A | 4/1993 | Dunstan | |
| 5,253,576 | A | 10/1993 | Bethke | |
| 5,524,437 | A | 6/1996 | Larkin et al. | |
| 5,927,176 | A | 7/1999 | Stölzer | |
| 6,517,322 | B2 | 2/2003 | Fiebing et al. | |
| 6,655,255 | B2 | 12/2003 | May | |
| 6,986,406 | B1 | 1/2006 | Hauser et al. | |
| 2004/0247454 | A1 * | 12/2004 | Donders | 417/269 |
| 2006/0008362 | A1 | 1/2006 | Hugelman | |

* cited by examiner

FOREIGN PATENT DOCUMENTS

| | | |
|---|---|---|
| SU | 1090910 | 5/1984 |

*Primary Examiner*—Charles G Freay
*Assistant Examiner*—Bryan Lettman
(74) *Attorney, Agent, or Firm*—Renner, Otto, Boisselle & Sklar, LLP

(57) ABSTRACT

A hydraulic axial piston pump is designed with a secondary swashplate angle for providing improved performance and life. The secondary swashplate angle produces a sideload on the swashplate that is reacted by the pump's housing. A hydrostatically balanced thrust bearing is used to counteract the sideload produced by the secondary swashplate angle. The bearing design includes a tiltable pad or shoe supplied with pressurized fluid from the pump's discharge port. The same fluid that supplies the tiltable pad may also supply the pump's cradle bearings.

12 Claims, 3 Drawing Sheets

HYDROSTATIC BEARING ARRANGEMENT FOR PUMP SWASHPLATE HAVING SECONDARY ANGLE

RELATED APPLICATION DATA

This application claims priority of U.S. Provisional Application No. 60/983,340 filed on Oct. 29, 2007, which is hereby incorporated herein by reference in its entirety.

FIELD OF THE INVENTION

The invention relates in general to a hydraulic axial piston pump, and more particularly to a pump having a secondary swashplate angle and that provides pressurized fluid to a hydrostatic thrust bearing for reacting the force generated by the secondary swashplate angle.

BACKGROUND

Swashplate-type axial piston pumps are commonly used devices used for generating hydraulic power. These pumps may be configured to provide a variable displacement flow for greater energy efficiency when compared with a non-variable displacement hydraulic pump. The pump component that provides variable displacement flow is a movable, inclined cam plate, typically referred to as a swashplate. The swashplate has a running surface upon which a group of pistons slide or travel. The swashplate ordinarily pivots on either roller or plain bearings. In either bearing case, the bearings are generally designed to provide low friction and long service life. Low friction bearings ensure proper controllability of the outlet flow. The benefits of long service life include lower lifecycle cost and reduced downtime. Other considerations in the design and selection of the swashplate bearings include size, weight, and initial cost among others. The benefits of reduced size, weight, and initial cost may be achieved by using plain swashplate bearings in lieu of roller bearings. The plain bearings are typically referred to as cradle bearings due to their semi-cylindrical shape. For an example of such cradle bearings, refer to U.S. Pat. No. 4,543,876 incorporated herein by reference in its entirety.

To reduce bearing friction to acceptable levels and to minimize wear, some plain bearing designs incorporate hydrostatic pockets in a semi-circular swashplate backside surface. The hydrostatic pockets may be supplied with pressurized fluid from a discharge port of the pump typically via transfer tubes or passages in the pump's housing.

Swashplate pumps are ordinarily designed such that the running surface of the swashplate is inclined solely about a single (primary) axis, which is perpendicular to the pump's driveshaft. The variable inclination of the swashplate about this axis allows for variable output flow. Some swashplate pumps also incorporate a second swashplate angle that is fixed at typically less than 4 degrees with respect to the variable plane passing through the primary axis. The benefits of incorporating this secondary swashplate angle may include a reduction in the size of the swashplate control mechanism (allowed by reducing the torque exerted on the swashplate by the pumping pistons). The smaller swashplate control mechanism may reduce the corresponding pump's size and weight.

Additionally, the pump's timing may be adjusted by the secondary swashplate angle to reduce fluid-borne noise.

The disadvantages of incorporating a secondary swashplate angle may include higher manufacturing costs and the need to react the side force exerted by the secondary angle. The thrust load developed by this side force can be approximately 5% of the thrust load reacted by the swashplate bearings. A common method of reacting this side force is via non-pressurized thrust bearings. These bearings may increase manufacturing costs, increase friction that impedes swashplate motion, and generate damaging wear particles due to the nearly continuous motion at the bearing interface.

SUMMARY OF THE INVENTION

The invention uses a hydrostatically balanced thrust bearing to counteract a sideload produced by a secondary swashplate angle of a hydraulic axial piston pump. The design includes a tiltable pad or shoe, supplied with pressurized fluid from the pump's discharge port, which pivots and/or slides about a flat plate. When supplied with pressurized fluid, the tiltable pad effectively becomes a hydrostatically balanced thrust bearing. Since the force exerted by the secondary swashplate angle is proportional to fixed geometry within the pump and discharge pressure, the tiltable pad is geometrically balanced, independent of varying discharge pressure. The same fluid that supplies the tiltable pad is also used to supply the cradle bearings.

Hydrostatic support of the sideload generated by the secondary swashplate angle provides the benefits of:

a) reduced friction, which improves control performance;

b) reduced wear, to improve pump life;

c) reduced contamination and subsequent damage to pump and hydraulic system components due to wear particles; and d) self-adjusted bearing support, wherein the load and bearing support is directly proportioned to the discharge pressure.

Discharge pressure is supplied to the pump's hydrostatic bearings via a common flow path for both the cradle bearings and the secondary swashplate angle bearing.

The embodiments of the pump shown herein reduce the passages in the pump housing, minimize external leak paths, and reduce pump complexity. In summary, the invention reduces overall pump cost, size, and weight, while providing a superior bearing configuration for reacting the secondary swashplate angle force, thereby improving reliability.

One aspect of the invention provides an axial piston pump, including a housing having an outlet port passage and a rotating group disposed in the housing. The rotating group has an axis of rotation and includes a barrel. The barrel includes: a plurality of cylinder bores, a plurality of piston assemblies (with each of the plurality of piston assemblies having a piston slideably disposed within one of the cylinder bores), and a shoe pivotably attached to and extending from each of the pistons. The rotating group is in fluid communication with the outlet port passage of the housing. A swashplate is disposed in the housing and is pivotable about a primary axis that is perpendicular to the axis of rotation of the barrel. The swashplate running surface has a fixed secondary angle with the primary swashplate axis that causes a side force during operation of the pump. The side force is transferred to the pump housing through a hydrostatic thrust bearing.

According to another aspect of the invention, the axial piston pump is a variable displacement pump.

According to another aspect of the invention, the hydrostatic thrust bearing includes a tiltable pad and a reaction plate that reacts the side force into the pump housing.

According to another aspect of the invention, the axial piston pump further includes an arm integral to, or attached to, the swashplate, wherein the side force is transferred through the arm to the hydrostatic thrust bearing.

According to another aspect of the invention, the tiltable pad includes a fluid passage.

According to another aspect of the invention, the tiltable pad includes a first side having a socket which forms a semi-spherical joint with the arm, and a second side including a surface which remains flat against the reaction plate during operation of the swashplate.

According to another aspect of the invention, the arm includes a ball that engages a socket of the tiltable pad. The socket, the ball, and the arm each have a fluid passage therethrough.

According to another aspect of the invention, the fluid passage through the arm transfers pressurized fluid from the hydrostatic thrust bearing through the swashplate and to a cradle bearing.

According to another aspect of the invention, the outlet port is in fluid communication with the hydrostatic thrust bearing.

According to another aspect of the invention, a method is provided for hydrostatically supporting a load generated by a secondary swashplate angle within a housing of an axial piston pump. The method includes: providing a rotating group within the housing (the group having an axis of rotation); providing a swashplate pivotable about a primary axis and oriented at a fixed secondary angle with the primary swashplate axis (the secondary swashplate angle resulting in a side force during operation of the pump); and transferring the side force through a hydrostatic thrust bearing to the pump housing.

The foregoing and other features of the invention are hereinafter fully described and particularly pointed out in the claims, the following description, and the annexed drawings setting forth in detail one or more illustrative embodiments of the invention, such being indicative, however, of but one or a few of the various ways in which the principles of the invention may be employed.

DETAILED DESCRIPTION

Figure 1:
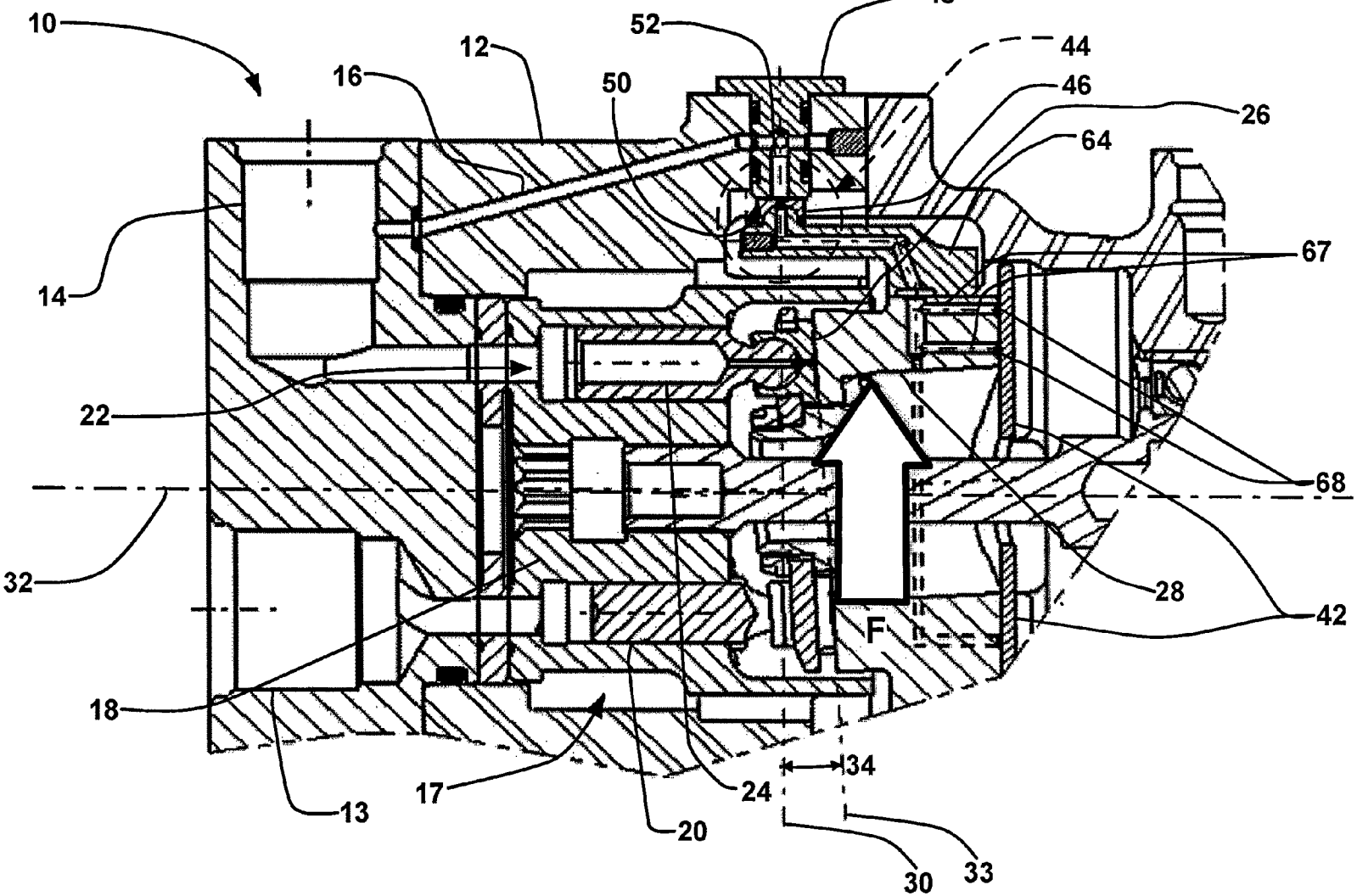
FIG. 1 is a partial cross-sectional view of an exemplary hydraulic pump in accordance with the invention, taken in a plane parallel to the primary axis of the swashplate.

Referring now to the drawings, FIG. 1 shows an exemplary pump 10 constructed in accordance with the invention (shown in partial cross-section). The pump 10 includes a housing 12 having an inlet port 13 and an outlet or discharge port 14. Pressurized fluid is communicated from the discharge port 14 via a passage, passages, or transfer tubes 16 to various hydrostatic bearings (discussed below).

The pump 10 includes a rotating group 17 disposed in the housing 12. The rotating group 17 includes a barrel 18 having a plurality of cylinder bores 20. The barrel 18 further includes a plurality of piston assemblies 22 wherein each of the piston assemblies 22 includes a piston 24 slideably disposed within one of the cylinder bores 20. The piston assemblies 22 may further include a piston shoe 26 pivotably attached to and extending from the piston 24. The rotating group 17 is in fluid communication with the inlet port 13 and the outlet port 14.

Further, the pump 10 includes a swashplate 28 disposed in the housing 12. The swashplate 28 is pivotable about a primary axis 30 that is perpendicular to a barrel axis of rotation 32. The swashplate includes a running surface (shown in FIG. 1 as plane 33) that may have a fixed secondary angle 34 with respect to the primary axis 30. The piston shoe 26 is slideably disposed on the swashplate running surface.

Figure 2:
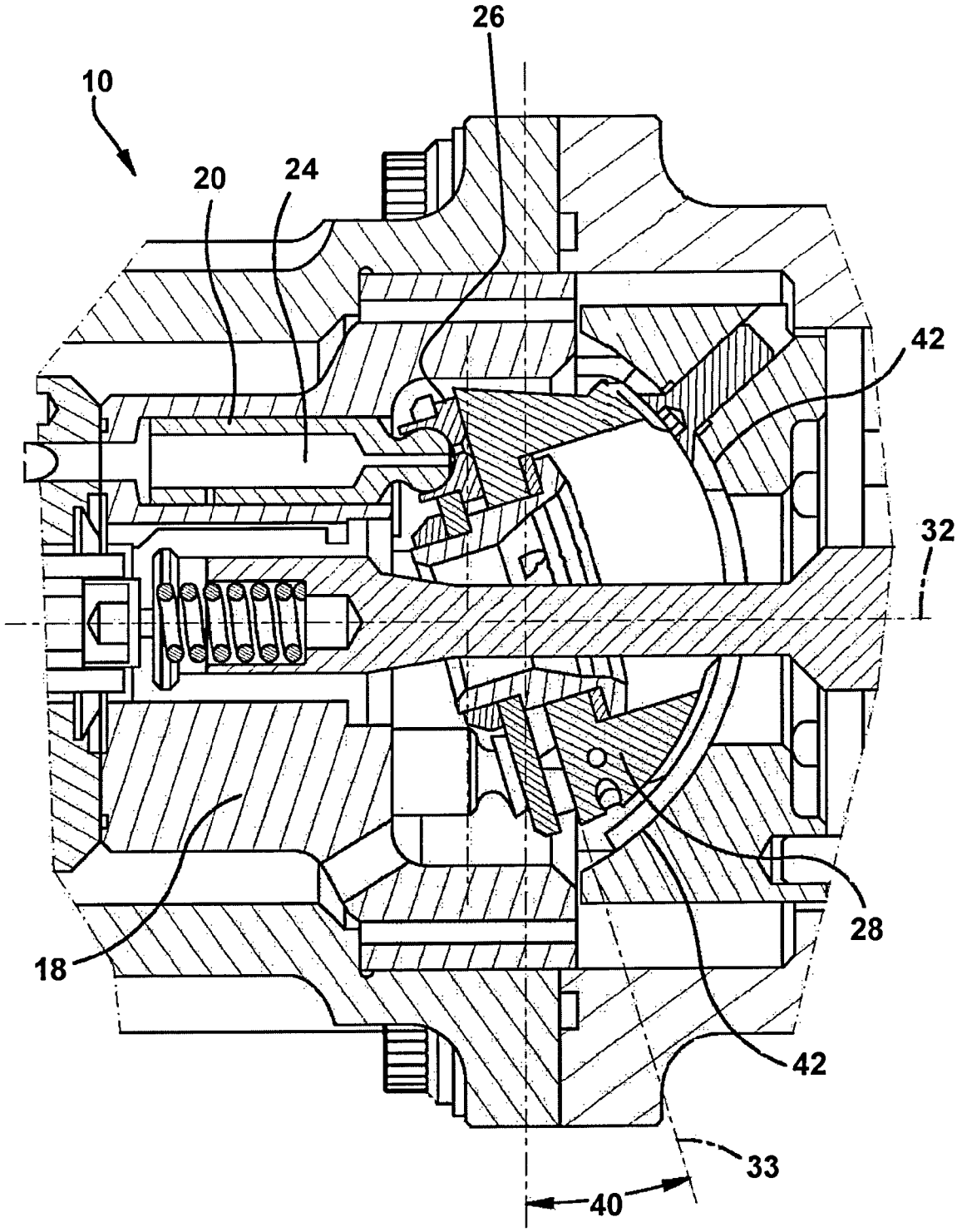
FIG. 2 is a cross-sectional view of an exemplary hydraulic pump in accordance with the invention, taken in a plane perpendicular to the primary axis of the swashplate.

Turning to FIG. 2, the pump 10 is shown in a cross-section cut perpendicular to the swashplate primary axis. The swashplate 28 acts as a cam and in a variable displacement pump the swashplate 28 is pivotable. For conceptual purposes the swashplate running surface or cam can be represented by the plane 33, the orientation of which, in combination with the rotation of the barrel 18, provides the cam action that leads to piston reciprocation and thus pumping. The angle between a vector normal to the cam plane 33 and the barrel axis of rotation 32, called cam angle 40, is one variable that determines the displacement of the pump 10 or the amount of fluid pumped per barrel rotation. If the pump 10 is a variable displacement pump, then the cam angle 40 may vary during operation to change the flow rate.

As the pistons 24 engage the swashplate 28 via the piston shoes 26, they apply a force to the swashplate 28. The force applied to the swashplate 28 is ordinarily reacted by a single cradle bearing or pair of cradle bearings 42.

Turning back to FIG. 1, the force applied by the pistons 24 to the swashplate 28 is no longer purely normal to the primary swashplate axis 30 due to the secondary angle 34 of the swashplate 28. Therefore, in addition to the normal forces reacted by the cradle bearings 42, a side force F is applied to the swashplate 28 that is reacted by a hydrostatic thrust bearing 44 (shown in a dashed circle and in FIG. 3).

The hydrostatic thrust bearing 44 includes a tiltable pad 46 and a reaction plate 48. The reaction plate 48 provides a rigid, smooth, flat surface 50 against which the tiltable pad 46 rides. The reaction plate 48 is secured to the housing 12 and reacts the side force F generated by the secondary swashplate angle 34 into the housing 12. Additionally, the reaction plate 48, via passages 52, communicates pressurized fluid from the passages 16 in the housing 12 to the tiltable pad 46.

Figure 3:
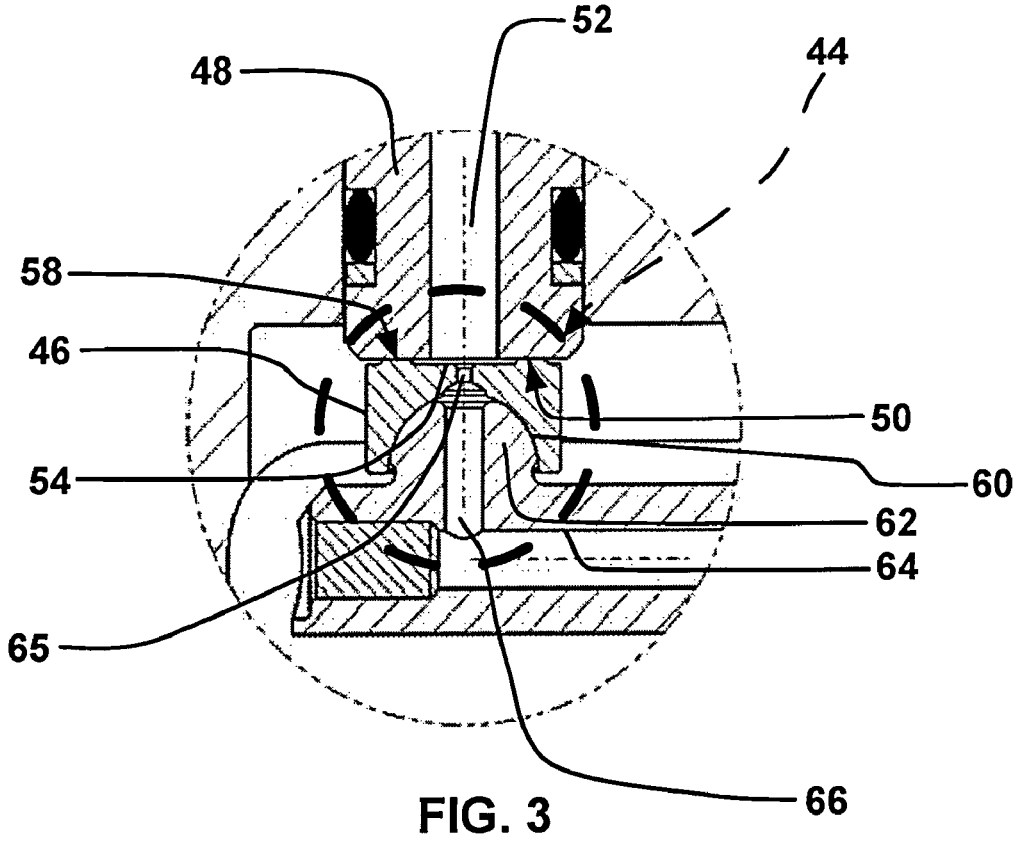
FIG. 3 is an enlarged view of the hydrostatic thrust bearing of FIG. 1.

Turning to FIG. 3, the tiltable pad 46 may include on one side a machined recess 54 that, by its pre-determined geometry, provides a hydrostatic pressure balance with the reaction plate 48. This hydrostatic balance may be set such that a small resultant force exists to prevent separation between the tiltable pad 46 and the reaction plate 48. Such a separation may result in leakage and possible loss of supply fluid to the cradle bearings 42 shown in FIGS. 1 and 2.

Additionally, a pair of bearing surfaces 50 and 58 between the reaction plate 48 and the tiltable pad 46 should be sufficiently flat, smooth, and rigid to prevent uneven bearing loads that may contribute to leakage and wear at this interface. The reaction plate 48 may be constructed from a strong, hard material such as heat-treated steel to provide a good bearing surface and for adequate support against structural and pressure loads.

The tiltable pad 46, on its opposite side, may include a semi-spherical socket 60 that mates with a semi-spherical ball 62 that is integral to an arm 64. The tiltable pad 46 contains a passage 65 through which pressurized fluid is communicated from the passage 52 to the semi-spherical ball 62. The pressurized fluid provides lubrication for this interface and is further provided through a passage 66 in the semi-spherical ball 62, and through the arm 64, to the cradle bearings 42. The resulting semi-spherical joint provides the freedom to allow the tiltable pad 46 to remain flat against the reaction plate 48 despite any misalignments caused by machining tolerances and structural deflections as the swashplate 28 tilts about the primary pivot axis. Due to the bearing loads on both of its sides, the tiltable pad 46 may be constructed of a good bearing material such as bronze.

Turning back to FIG. 1, the arm 64, which may be either integral with or affixed to the swashplate 28 by a bolted connection or other securement, acts as a conduit for the transfer of pressurized fluid from the tiltable pad 46 through passages 67 in the swashplate 28 and into hydrostatic bearing pockets 68 at the cradle bearing 42 interface. The force F generated by the secondary swashplate angle 34 is transmitted through the arm 64 to the tiltable pad 46. The arm 64 should be of sufficient strength to withstand the applied bending loads and may be constructed of a strong material such as steel.

There are numerous optional designs for communicating fluid from the discharge port 14 to the tiltable pad 46. The design selected for use in FIG. 1 is merely exemplary and the invention is not intended to be limited to this configuration.

Figure 4:
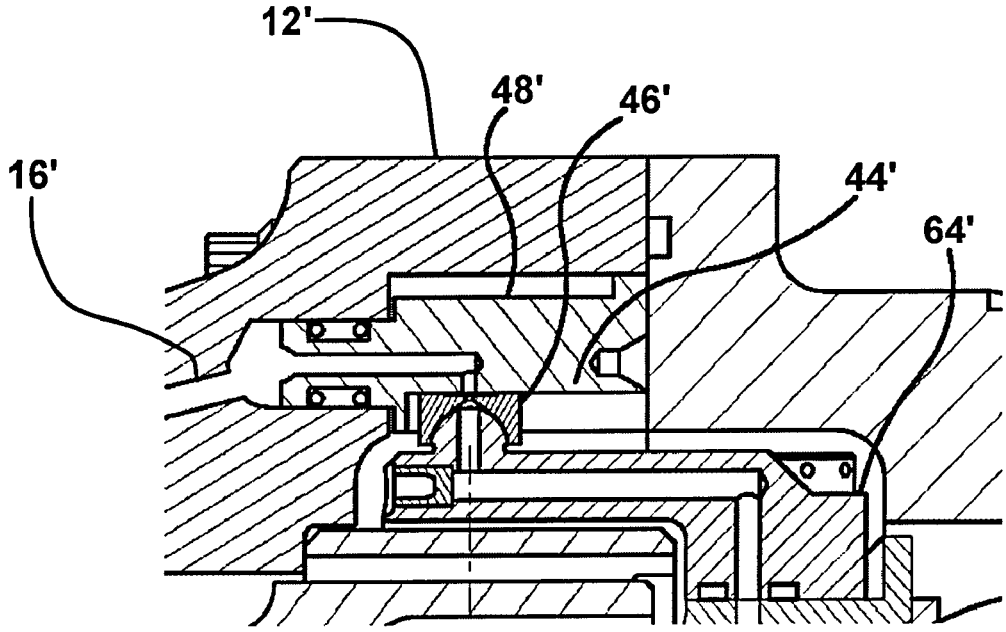
FIG. 4 is a partial cross-sectional view of a second exemplary hydrostatic thrust bearing and housing configuration in accordance with the invention.

Turning now to FIG. 4, a second thrust bearing and housing configuration constructed in accordance with the invention is shown in partial cross-section. The housing 12' includes a second configuration of passage, passages, or transfer tubes 16' for communicating pressurized fluid to the various hydrostatic bearings discussed above.

In the configuration of FIG. 4, a hydrostatic thrust bearing 44' includes a tiltable pad 46' and a reaction plate 48'. The reaction plate 48' again provides a rigid, smooth, flat surface against which the tiltable pad 46' rides. The reaction plate 48' is secured to the housing 12' and reacts the side force generated by the secondary swashplate angle into the housing 12'. Additionally, the reaction plate 48' communicates pressurized fluid from the passages 16' in the housing 12' to the tiltable pad 46' and through an arm 64' to supply fluid to the cradle bearings (not shown).

The configuration of the housing 12' and the securement of reaction plate 48' in FIG. 4 differs from that of FIG. 1 in that it reduces external leakpaths and thus the need for external seals.

Although the invention has been shown and described with respect to a certain preferred embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including any reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

What is claimed is:

1. An axial piston pump, comprising:

a housing having an outlet port passage;

a rotating group having an axis of rotation disposed in the housing, the rotating group comprising:

a barrel including a plurality of cylinder bores; and a plurality of piston assemblies wherein each of the plurality of piston assemblies includes a piston slideably disposed within one of the cylinder bores;

wherein the rotating group is in fluid communication with the outlet port passage of the housing;

a swashplate disposed in the housing and being pivotable about a primary axis that is perpendicular to the axis of rotation of the rotating group;

wherein the swashplate is oriented at a fixed secondary angle with the primary swashplate axis, the secondary swashplate angle causing a side force to be applied to the swashplate during operation of the pump; and a hydrostatic thrust bearing through which the side force is transferred to the pump housing.

2. The axial piston pump according to claim 1, wherein the wherein the pump is a variable displacement pump.

3. The axial piston pump according to claim 2, wherein the hydrostatic thrust bearing comprises:

a tiltable pad; and a reaction plate which reacts the side force into the pump housing.

4. The axial piston pump according to claim 3, wherein the tiltable pad includes a fluid passage therethrough.

5. The axial piston pump according to claim 3, further comprising an arm integral to, or attached to, the swashplate, wherein the side force is transferred through the arm to the hydrostatic thrust bearing.

6. The axial piston pump according to claim 5, wherein the tiltable pad comprises:

a first side comprising a socket which forms a semi-spherical joint with the arm; and a second side comprising a surface which remains flat against the reaction plate during operation of the swashplate.

7. The axial piston pump according to claim 5, wherein the arm comprises a ball that engages a socket of the tiltable pad and the socket, the ball, and the arm each having a fluid passage therethrough.

8. The axial piston pump according to claim 7, wherein the fluid passage through the arm transfers pressurized fluid from the hydrostatic thrust bearing to passages through the swashplate, and to a swashplate cradle bearing.

9. The axial piston pump according to claim 1, wherein the outlet port is in fluid communication with the hydrostatic thrust bearing.

10. A method of hydrostatically supporting a side load generated by a secondary swashplate angle within a housing of an axial piston pump, comprising:

providing a rotating group having an axis of rotation within the housing, the rotating group comprising:

a barrel including a plurality of cylinder bores; and a plurality of piston assemblies wherein each of the plurality of piston assemblies includes a piston slideably disposed within one of the cylinder bores;

providing a swashplate pivotable about a primary axis and oriented at a fixed secondary angle with the primary swashplate axis, the secondary swashplate angle causing a side force to be applied to the swashplate during operation of the pump; and transferring the side force through a hydrostatic thrust bearing to the pump housing.

11. The method according to claim 10, wherein the hydrostatic thrust bearing comprises a tiltable pad and a reaction plate that reacts the side force into the pump housing.

12. The method according to claim 11 further comprising providing a fluid passageway from a pump discharge outlet through the hydrostatic thrust bearing to a swashplate cradle bearing of the pump.

* * * * *